US005924338A

United States Patent [19]

Peck

[11] Patent Number: 5,924,338

[45] Date of Patent: Jul. 20, 1999

[54] CORK EXTRACTOR

[75] Inventor: Julian Peck, Kingston-upon-Thames, United Kingdom

[73] Assignee: Vacu Products B.V., Delft, Netherlands

[21] Appl. No.: 09/029,225

[22] PCT Filed: Aug. 28, 1996

[86] PCT No.: PCT/GB96/02112

§ 371 Date: Feb. 25, 1998

§ 102(e) Date: Feb. 25, 1998

[87] PCT Pub. No.: WO97/08095

PCT Pub. Date: Mar. 6, 1997

[30] Foreign Application Priority Data

Aug. 31, 1995 [GB] United Kingdom ..... 9517784

[51] Int. Cl.[6] ..... B67B 7/62

[52] U.S. Cl. ..... 81/3.37; 81/3.29

[58] Field of Search ..... 81/3.36, 3.37, 81/3.29, 3.48

[56] References Cited

FOREIGN PATENT DOCUMENTS

| | | | |
|---|---|---|---|
| 212 367 | 10/1908 | Germany . | |
| 366 435 | 2/1932 | United Kingdom . | |
| 570680 | 7/1945 | United Kingdom | 81/3.29 |
| 1 188 579 | 4/1970 | United Kingdom . | |
| 2 127 795 | 10/1984 | United Kingdom . | |

*Primary Examiner*—James G. Smith

*Attorney, Agent, or Firm*—Heller Ehrman White & McAuliffe

[57] ABSTRACT

Apparatus comprising a worm (14) that engages with a control nut (9), such that the worm spirals through the nut into the cork (4) on insertion while the nut remains stationary, then the cork is extracted by an upward force on the nut. Mechanical advantage may feature on the insertion and/or extraction processes. Both the upward force and the torque on the worm from the nut are balanced by non-frictional forces from the cork, arising from frictional forces between the bottle (2) and the cork. Having independent insertion and extraction mechanisms enables these mechanisms to be controlled independently and enables the worm to be inserted to and extracted from different depths, depending on the length of the cork. This is not possible in previous nut corkscrews, which rely either on latches at the end of the insertion stroke or on friction between the cork and the worm.

19 Claims, 6 Drawing Sheets

15
18
15
10
11
16
23
24
16
23
24
22
17
22
17
25
26
19
25
26
1
14
5
8
6
9
4
2

CORK EXTRACTOR

This invention relates to a cork extractor or corkscrew.

Corkscrews are already known in prior art. The most usual modus operandi is a three-stage process as follows:

1. Insertion: part of the corkscrew (a worm) is rotated as it is inserted and engages with the cork.

2. Extraction: The worm is drawn away from the bottle, bringing with it the cork.

3. Cork removal: The cork is removed from the corkscrew.

I shall term corkscrews employing this three stage process conventional corkscrews; the present invention relates to conventional corkscrews.

There exists a body of prior art within conventional corkscrews in which the insertion and cork removal processes are effected by means which convert a linear force into a rotational force by driving the worm through a nut. I shall term these inventions nut corkscrews; the present invention relates to nut corkscrews and improves on existing nut corkscrews.

Examples of nut corkscrews are provided by U.S. Pat. Nos. 532,575 and 678,773 and by UK patent No. 2,127,795. These corkscrews are quick and easy to use but suffer from several problems which only come to light when these devices are tested on a wide range of bottles and corks. These problems include: mechanical complexity; inherent unreliability as a result of excess mechanical complexity; inability to extract shorter corks without piercing the bottom of the cork; ungainly operation due to inherently unbalanced forces. In particular whilst UK patent No. 2,127,795 addresses several of the problems encountered with earlier nut corkscrews there remains an inherent risk of unwinding the worm from the cork rather than extracting the cork from the bottle. I shall term this problem the backing out problem.

Among the numerous design objectives for a conventional corkscrew should be included:

ease of use
speed of use
intuitiveness
means of ensuring that the worm is inserted co-axially with the cork
means for ensuring that the cork is extracted in a straight line along its own axis
means for reducing the forces required throughout the process, and for balancing the remaining forces or directing them along the axis of the bottle
ability to extract corks of varying lengths without causing any part of the cork to remain inside the bottle or to break off and drop into the wine (for conventional corkscrews this implies the ability to control the depth to which the worm is inserted in the cork)
economy of manufacture
reliability and durability
attractiveness of appearance The prior art does not provide a nut corkscrew in which all the major forces are either balanced or directed along the axis of the bottle, nor one wherein the worm may be inserted to different depths according to the length of cork.

The objects of the present invention include the provision of a corkscrew achieving at least some of the objectives in the list above while overcoming problems associated with prior art corkscrews, such as those described in the text above.

As used herein, terms such as up and down, upper and lower, upward and downward, above and below will be construed with respect to the apparatus as it would appear when positioned for use on a bottle standing upright. The terms axial and longitudinal both refer to the vertical direction, parallel with the longitudinal axis of the bottle, cork and worm. Such terms are used for convenience and should not be construed in a limiting sense.

According to the present invention there is provided apparatus for extracting a cork from a bottle comprising:

engagement means for engaging a bottle;

first actuator means comprising a worm, said worm having an axis extending along its length, said first actuator means being movable in the axial direction of said worm with respect to said engagement means and being rotatable about said axis relative to said engagement means;

second actuator means movable in the axial direction of said worm relative to said first actuator means, said second actuator means and said first actuator means being arranged whereby such relative axial movement therebetween causes rotation of said worm relative to said second actuator means about said axis, said second actuator means being movable with respect to said engagement means in the axial direction of said worm and being substantially prevented from rotating about the axis of said worm with respect to said engagement means;

first actuator control means for controlling the axial movement of said first actuator means relative to said engagement means;

and;

second actuator control means, separate from said first actuator control means, for controlling the axial movement of said second actuator means relative to said engagement means.

Embodiments of the present invention thus allow a user to control the axial movement of the first actuator means and thus the worm, and separately to control the axial movement of the second actuator means and thus the control nut. The user is thus afforded the means with which to decide to what extent the first actuator means is to move axially relative to the second actuator means such as to cause relative rotation therebetween and when the two actuators are to be moved axially together. Insertion of the worm into a cork may be achieved by virtue of a phase of relative movement, after which extraction of the cork from the bottle may be achieved by virtue of a phase of common movement of the first and second actuators away from the bottle. Finally, the cork may be ejected from the worm by a further phase of relative movement, causing the worm to 'spiral out' of the cork. After this third phase, the apparatus is ready for use again.

According to preferred embodiments of the present invention, the worm is a standard helical worm and the second actuator means comprises a control nut having a passage therethrough having a helical curvature such as to receive the worm. In order to decrease the amount of force required to insert the worm into a cork the worm may be coated with a friction-reducing coating, and it may be advantageous to ensure that the part of the worm which is to penetrate corks does not come into contact with such a passage in order to preserve the coating. The apparatus may achieve this by being arranged in such a way that a part of the first actuator means other than the worm itself comes into contact with the second actuator means. In this case the relationship between relative axial movement between the first and second actuator means and relative rotational movement between the first and second actuator means may be achieved by means of helical components which are not the worm, mounted on the first and/or second actuator means.

In preferred embodiments, the first and second actuator control means may each comprise force conversion means for converting forces applied by a user into longitudinal forces acting axially on the first and second actuator means. Either or each of the force conversion means may, for example, be a rack and pinion arrangement, allowing a user to apply appropriate forces to the force conversion means by applying a force to a force application means such as an arm or a pair of arms. Alternatively, the first actuator control means may comprise a rotary insertion means whereby a user may apply a torque to the first actuator about the axis of the worm.

Some embodiments of the present invention will now be described with reference to the accompanying drawings in which:

FIG. 1 shows the apparatus in its initial position, prior to insertion of the worm into the cork. One half of the body has been removed to enable the main internal working parts to be seen and the sleeve, bottle and cork are shown in section.

FIG. 2 shows the insertion rack and worm sub-assembly.

FIG. 3 shows a top view of the extraction carrier, showing the off-centre hole that enables this component also to comprise the control nut.

FIG. 4 shows the main working parts of the apparatus, with the body and the sleeve removed for clarity and the bottle and cork shown in section, after insertion of the worm and prior to extraction of the cork.

FIG. 5 shows the main working parts of the apparatus, with the body and the sleeve removed for clarity and the bottle and cork shown in section, after extraction of the cork and prior to cork removal from the worm.

The co-planar embodiment of the present invention will now be described by reference to FIGS. 1 to 5.

Figure 1:
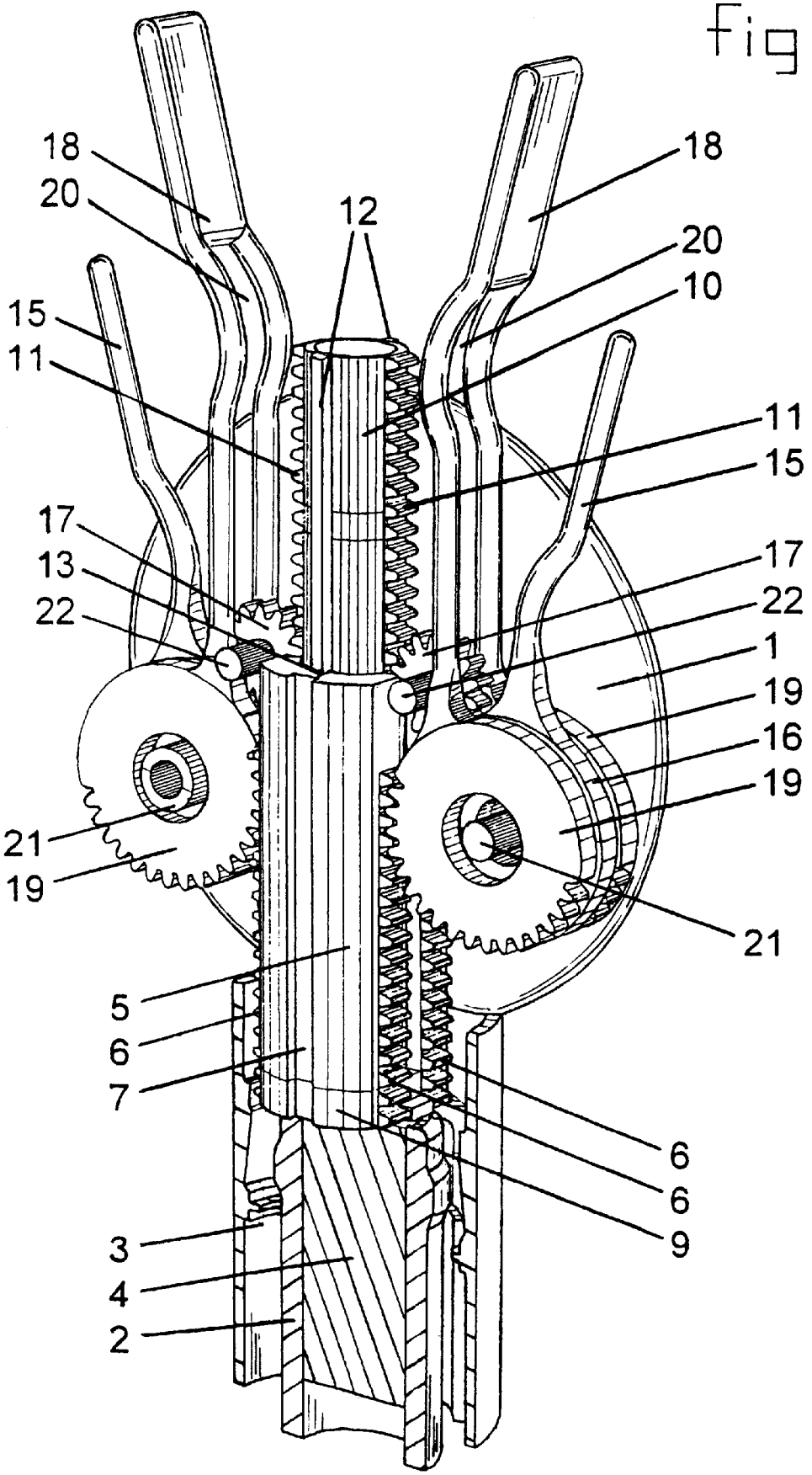
FIGS. 1 to 5 show different aspects of the co-planar embodiment of the present invention, so called because the plane of symmetry of the insertion mechanism is co-planar with that of the extraction mechanism.

Referring first to FIG. 1 there is shown one half of the body 1 which may be engaged with a bottle 2 by means of a sleeve 3. There is a cork 4 in the neck of the bottle 2. The sleeve 3 is free to move axially within limits with respect to the body 1 and acts on a tapered part (not shown) of the body 1 to squeeze the lower part of the body 1 inwards so that the body 1 grips the bottle 2.

Figure 3:
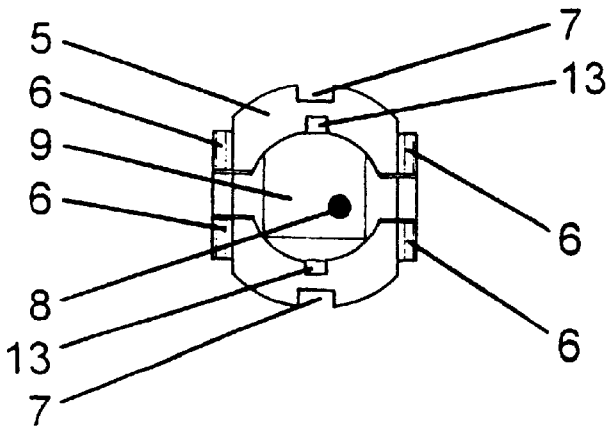

Inside the body 1 there is an extraction carrier 5 integral with which are four extraction racks 6. This is also shown in FIG. 3. The extraction carrier 5 is free to slide axially with respect to the body 1 and is prevented from rotating by a pair of ridges (not shown) inside the body 1 which slide in a pair of grooves 7 in the extraction carrier 5. The base of the extraction carrier 5 has a helical hole 8 and therefore comprises a control nut 9.

Figure 2:
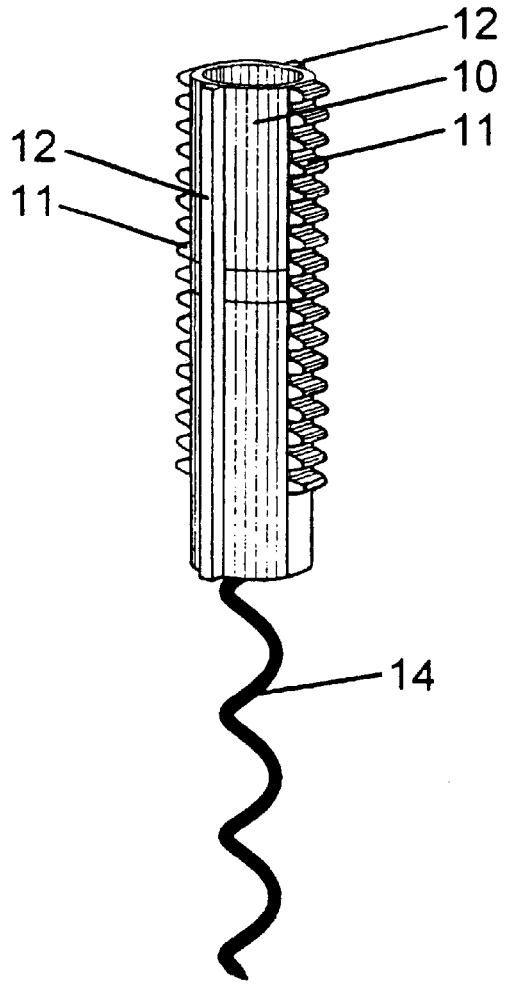

Inside the extraction carrier 5 and substantially parallel and concentric with it there is an insertion carrier 10 which is free to slide axially with respect to the extraction carrier 5 and which is free to slide axially with respect to the body 1. This is shown in FIG. 2. The insertion carrier 10 is maintained in this alignment relative to the extraction carrier 5 by an overlap therebetween. Integral with the insertion carrier 10 are two insertion racks 11. The insertion carrier 10 is prevented from rotating relative to the extraction carrier 5 by a pair of ridges 12 on the insertion carrier 10 which slide within a pair of grooves 13 in the extraction carrier 5.

A helical worm 14 is rotatably mounted inside the insertion carrier 10 for joint longitudinal movement therewith, the axis of rotation of the worm 14 being generally coincident with its own axis. The worm 14 is maintained in this alignment at its upper end by the insertion carrier 10 and at its lower end by the hole 8 in the control nut 9.

The hole 8 in the control nut 9 is substantially helical in form and the axis of the helix of the hole 8 is substantially coincident with the axis of the worm 14 so that the worm 14 can pass freely through it provided that the worm 14 rotates at the rate determined by the pitch of its helix.

FIG. 1 also shows that the insertion carrier 10 is actuated insertion means comprising an opposing pair of insertion levers 15 mounted on an opposing pair of insertion gears 16 acting through an opposing pair of direction reverser pinions 17 onto the two opposing insertion racks 11. The extraction carrier 5 is actuated by extraction means comprising an opposing pair of extraction levers 18 mounted on two opposing pairs of extraction gears 19 acting on the extraction racks 6 on opposite sides of the extraction carrier 5. The extraction levers 18 have slots 20 through which the insertion levers 15 may pass.

The insertion gears 16 and extraction gears 19 are mounted on main axles 21 integral with the body 1. The direction reverser pinions 17 also comprise direction reverser axles 22 which are supported at each end in bearings (not shown) integral with the body 1.

Figure 4:
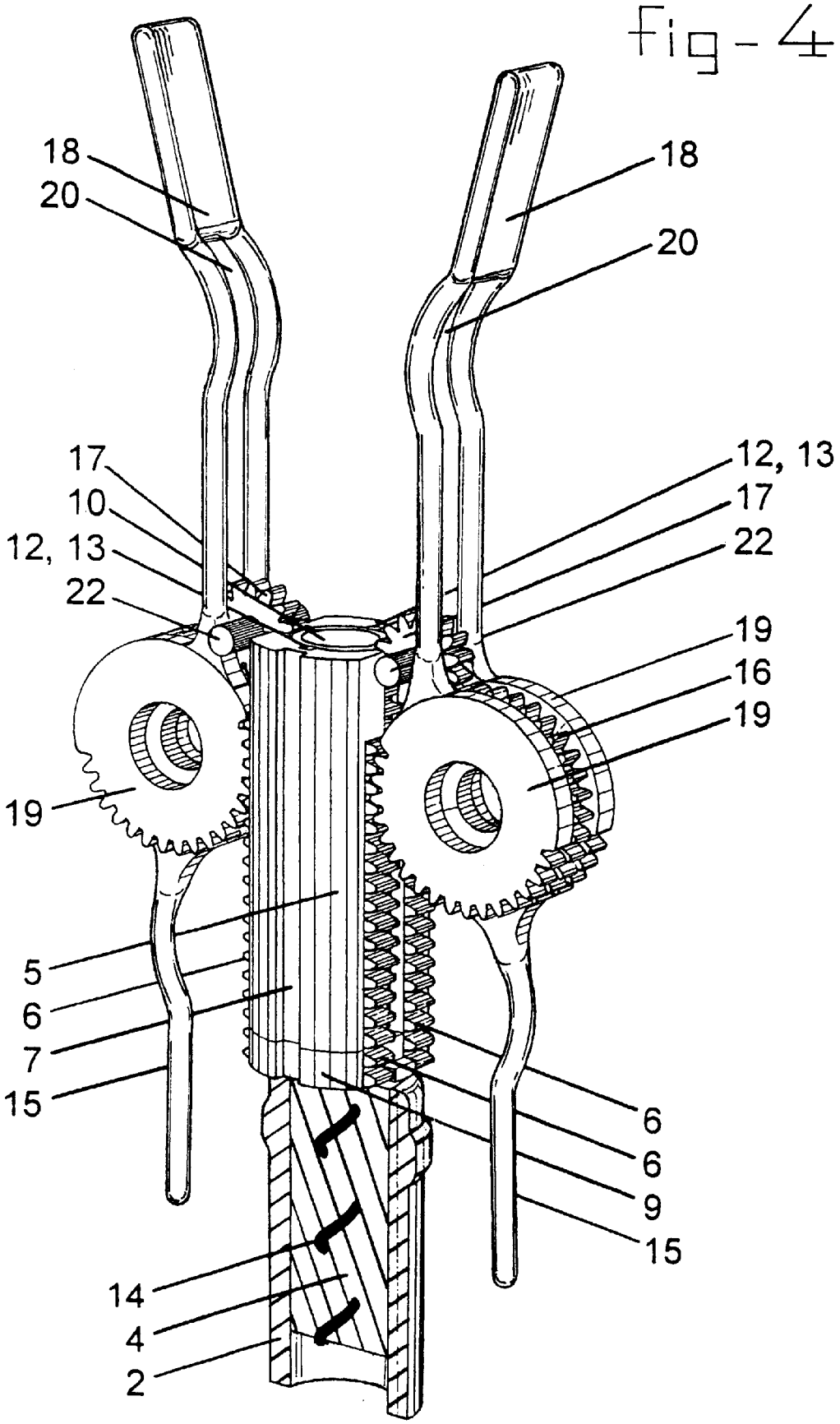
Figure 5:
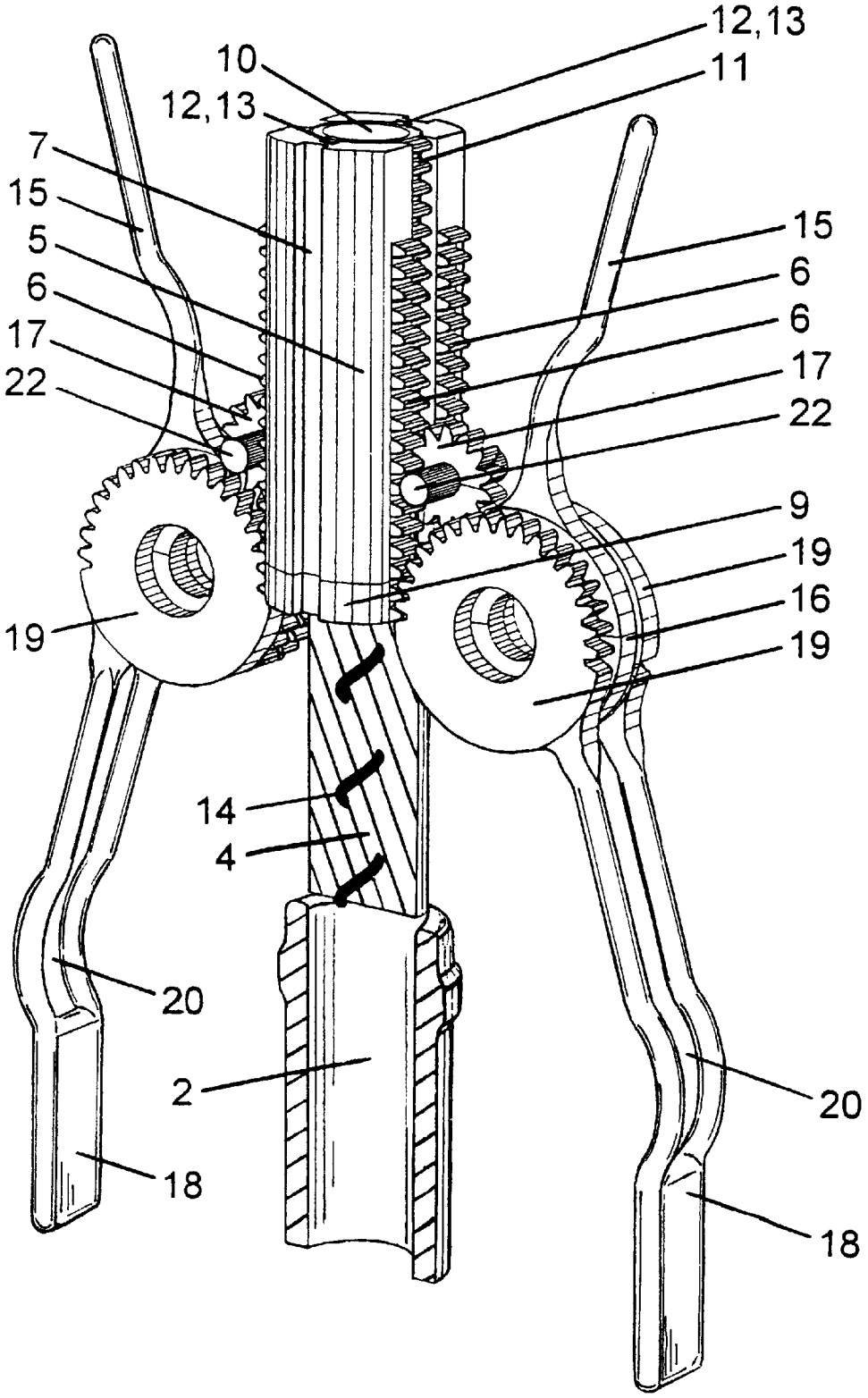

The operation of the co-planar embodiment will now be described with reference to FIGS. 1, 4 and 5.

The bottle 2 is placed on a table and the apparatus is brought down axially over the neck of the bottle 2. The sleeve 3 is then pulled down axially relative to the body 1, squeezing the taper on the lower part of the body 1 and solidly engaging the apparatus with the bottle 2. The grip between the body 1 and the bottle 2 may be improved if there are elastomeric pads on the inside of the lower part of the body 1.

With the apparatus securely engaged with the bottle 2, the two insertion levers 15 are depressed, causing the insertion gears 16 and direction reverser pinions 17 to rotate and the insertion carrier 10 and worm 14 to move axially down inside the extraction carrier 5. The hole 8 in the control nut 9 causes the axially moving worm 14 to assume in addition a rotational movement so that the worm 14 rotates at a rate determined by the pitch of its helix and it enters the cork 4 as shown in FIG. 4.

For a long cork the insertion levers 15 will be depressed to their full extent, but for a shorter cork it is preferable to depress them only partially in order to prevent the worm 14 piercing the bottom of the cork 4.

With the worm 14 engaged in the cork 4, the extraction levers 18 are depressed, causing the extraction gears 19 to rotate and the extraction carrier 5 to move axially up inside the body 1. The worm 14 is prevented from rotating as the control nut 9 is withdrawn because the torque applied to the worm 14 by the control nut 9 is equal in magnitude and opposite in direction to the torque applied to the worm 14 by the cork 4. It will be noted that throughout this extraction phase, applied forces are conveyed directly to the control nut 9, and that forces applied to the worm 14 are conveyed to it via the control nut 9. The worm 14 is therefore pushed upwards without rotating by the control nut 9 and the cork 4 is extracted from the bottle 2. The worm 14 in turn pushes up the insertion carrier 10 which causes the direction reverser pinions 17 and insertion gears 16 to rotate and the insertion levers 15 to rise back through the slots 20 in the extraction levers 18 to their initial positions as shown in FIG. 5.

With the cork 4 thus extracted, the apparatus is disengaged from the bottle 2 by lifting the sleeve 3 up off the tapered part of the body 1 and lifting the entire apparatus up away from the bottle 2.

Alternatively the sleeve 3 can be lifted up off the tapered part of the body 1 by means of a prong (not shown) integral with the extraction carrier 5. In this case, the prong extends down below the bottom of the extraction carrier 5 such that the end of the prong is inside the sleeve 3. The prong then lifts the sleeve 3 at the same time as the extraction carrier 5 is being raised to extract the cork 4.

Finally the cork 4 is removed from the apparatus by grasping the two extraction levers 18 and lifting them back up together. This initially causes the insertion levers 15 to drop from their upper position, until the insertion levers 15 and extraction levers 18 coincide at about the half-way point, with the insertion levers 15 inside the slots 20 in the extraction levers 18. At this stage the user will grasp all four levers, an insertion lever 15 and an extraction lever 18 in each hand, and pull them up. This will force the insertion carrier 10 to slide relative to the extraction carrier 5 and the cork 4 to be pushed off the worm 14 by the control nut 9. The cork 4 drops away from the apparatus and the apparatus is now restored to its initial position.

The force required for this last (cork removal) process may be reduced if the worm 14 is coated with a friction reducing material such as polytetrafluoroethylene or another suitable plastic, or if asperities are removed from its surface by a suitable polishing process. The frictional force may be further reduced if the control nut 9 is made from a low-friction plastic or the hole 8 in the control nut 9 is coated or lined with a friction reducing material. These friction reductions will also reduce the force required during the earlier process of inserting the worm 14 into the cork 4.

Although the mechanical effort required in the cork removal process is not great, this may be further reduced by inserting a weak compressive spring between the top of insertion carrier 10 and the bottom of extraction carrier 5. This would become compressed during the insertion process, would remain compressed during the extraction process and would extend to assist the cork removal process. This spring would also ensure that the apparatus would naturally assume its initial position, thereby making it more intuitive for the novice user.

The way in which the co-planar embodiment of the present invention solves the problems encountered with previous nut corkscrews is through the provision of the two independently operable pairs of levers. The fact that the user has, via the extraction levers, the ability directly to apply a longitudinal force to the control nut obviates the need for the various latching systems and other means of controlling whether the control nut is fixed relative to the body or moves jointly with the insertion carrier.

In the prior art the control nut is either controlled by various latching means (U.S. Pat. No. 678,773) or relies on a combination of latching means and a variety of frictional forces (U.S. Pat. No. 532,575 and UK patent No. 2,127,795). As a result the prior art either requires the insertion carrier to be moved to (or almost to) the limit of its freedom of movement in order for a latching means to be actuated or suffers from at least some risk of experiencing the backing out problem as a result of relying to some extent on frictional forces to prevent rotation of the worm relative to the control nut during extraction.

In embodiments of the present invention, the provision of the separate insertion levers and extraction levers thus enables the entire process to be performed without any latching means and without relying on any frictional forces. This therefore reduces the mechanical complexity of the device, improving its economy of manufacture and its inherent reliability. The use in embodiments of the present invention of the separate insertion levers and extraction levers is also what enables such embodiments of the present invention to avoid piercing shorter corks, as the extraction process can be started before the insertion carrier has descended to the lower limit of its freedom of axial movement relative to the body. Embodiments of the present invention do not rely on friction between the worm and the cork, as in the absence of friction on the worm the axial tension and torque on the worm from the cork will be equal and opposite to the axial tension and torque on the worm from the control nut. The application of friction reducing means described earlier will not cause a backing out problem (although it may lead to the cork rotating slightly in the bottle as it is extracted), as the design of embodiments of the present invention ensures that it is not susceptible to backing out, as described earlier.

The ungainly operation of the prior art devices on account of their inherently unbalanced forces is also avoided in embodiments of the present invention by the provision of the two independently operable pairs of levers. It is by having two sets of independently operable levers that the operation of embodiments of the present invention may be subtantially limited to two downward strokes, thereby ensuring that the only major force from the apparatus on the bottle is an axial compression, counteracted by an increased reaction from the table on which the bottle is standing.

Throughout the worm insertion and cork extraction processes, the main forces applied to the levers are either balanced by each other or directed substantially along the longitudinal axis of the bottle. Depressing the insertion levers gives rise to a tensile force between the body and the bottle and the bottle engagement means must provide means of transmitting this tensile force.

Although the drawings accompanying this description all show apparatus with right-handed helical worms, the worm may be left or right handed provided that the control nut is configured to suit, and the worm may be a substantially helical or Archimedian worm. One of the advantages of most embodiments of the present invention is that they are as easy to use for the left-handed as for the right-handed user. The helical worm is generally preferred because it tends to cause less damage to the cork.

It should be noted that the above description only describes one embodiment of the present invention. There shall now follow a brief description of some other embodiments of the present invention.

In the parallel embodiment of the present invention (not shown) the apparatus is essentially as described in the co-planar embodiment except that the plane of symmetry of the insertion levers, gears and racks is parallel to but not coincident with the plane of symmetry of the extraction levers, gears and racks.

The non-parallel embodiment of the present invention (not shown) is essentially as described in the co-planar embodiment except that the planes of the insertion levers, gears and racks and the extraction levers, gears and racks are arranged at an angle to each other which is not zero.

Figure 6:
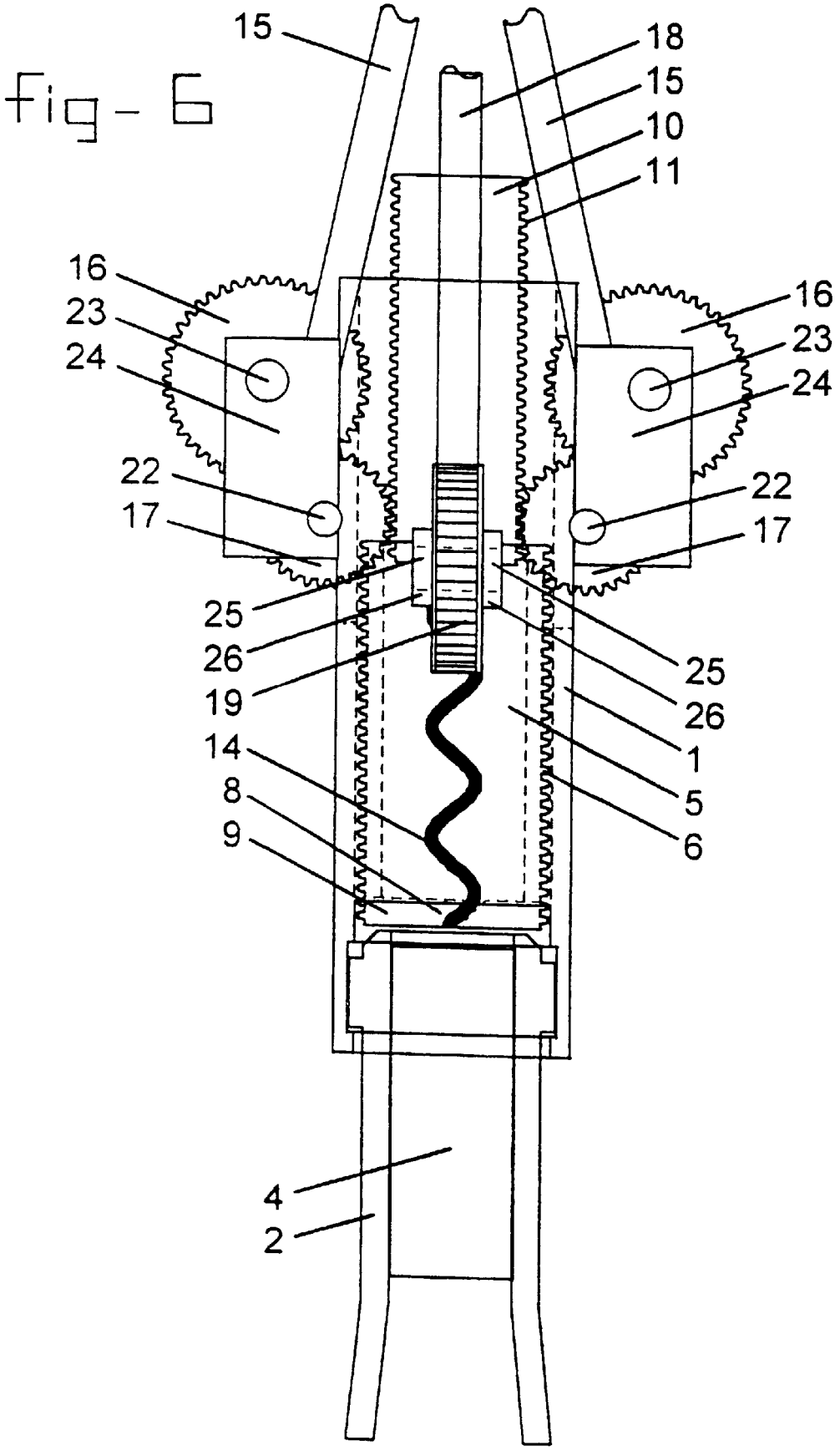
FIG. 6 shows the orthogonal embodiment in its initial position, prior to insertion of the worm into the cork.

In the limit, this becomes the orthogonal embodiment in which the insertion levers, gears and racks are orthogonal to the extraction levers, gears and racks. In the orthogonal embodiment as shown in FIG. 6, the body 1, extraction carrier 5 and insertion carrier 10 are concentric and substantially cylindrical in form. The extraction gears 19 act on a plurality of equally spaced circular grooves on the extraction carrier 5, which together comprise the extraction rack 6, through slots in the body 1. The direction reverser pinions 17 act on a plurality of equally spaced circular grooves on the insertion carrier 10, which together comprise the insertion rack 11, through slots in the body 1 and slots in the extraction carrier 5. The extraction carrier 5 is prevented from rotating by means of a grub screw (not shown) held in the body 1 and constrained by a longitudinal groove (not shown) in the exaction carrier 5. The insertion carrier 10 is not prevented from rotating relative to the extraction carrier 5. The insertion gears 16 are mounted on insertion axles 23 in insertion plates 24 and the direction reverser gears 17 are mounted on direction reverser axles 22 in the insertion plates 24. The extraction gears 19 are mounted on extraction axles 25 (hidden) in extraction plates 26. The insertion plates 24 and extraction plates 26 are mounted substantially orthogonally to each other on the body 1.

The crossed-lever embodiment of the present invention (not shown) is essentially a variant on any of these embodiments in which the insertion means is by direct pressure from the insertion levers onto a cam mounted on the insertion carrier. The insertion levers are mounted on the body, across the central axis of the apparatus so that they pass across the cam on the insertion carrier, eliminating the need for the insertion gears, direction reverser pinions and insertion racks.

The ratchet embodiment of the present invention (not shown) employs releasable ratchets on the insertion gears and the extraction gears. This requires that each pair of levers be pushed down more than once in order to achieve the full 50 mm longitudinal movements of the insertion carrier and the extraction carrier necessary to extract a full-length cork. However it enables the apparatus to offer the same mechanical advantage whilst using smaller gears and shorter levers throughout. This reduces the overall height and width of the apparatus. Another advantage of this embodiment is that the apparatus could be 'folded up' with all its levers tidily in the down position when not in use.

All the above embodiments describe devices operated by pairs of levers but the scope of the invention is not limited to embodiments wherein each set of levers comprises two levers, although such embodiments are likely to be preferred by two-handed users. In addition the scope of the invention is not limited to embodiments in which the insertion and extraction mechanisms are operated by a lever or a plurality of levers but covers any other operation means also.

Figure 7:
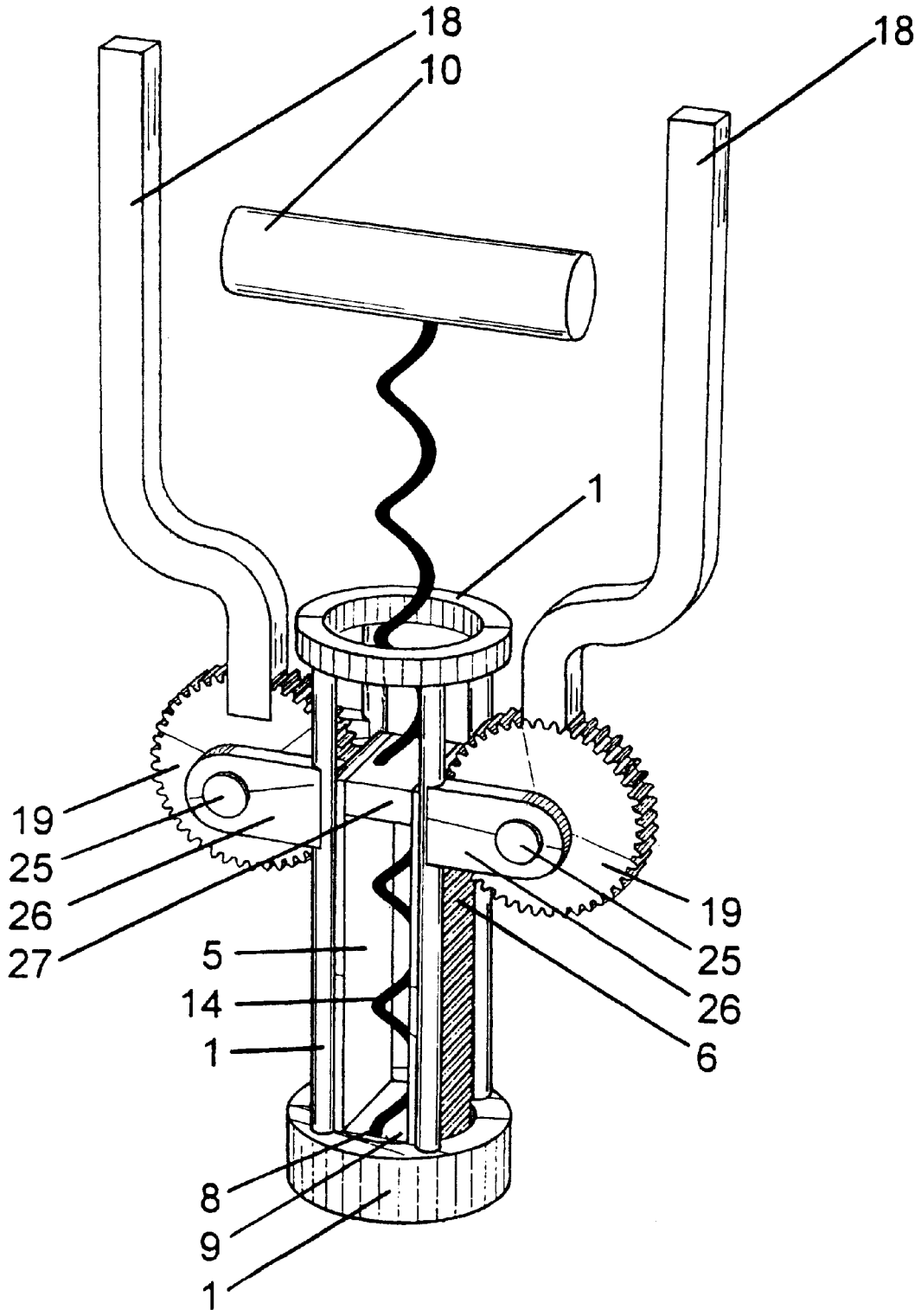
FIG. 7 shows the rotary insertion embodiment in its initial position, prior to insertion of the worm into the cork.

In particular the rotary insertion embodiment of the present invention is shown in FIG. 7 and employs an extraction means substantially as described in the co-planar embodiment but provides an insertion means in which the insertion levers 15, insertion gears 16, direction reverser pinions 17 and insertion racks 11 are omitted. In the absence of these components there is no need for the bottle engaging means to transmit a tensile force between the apparatus and the bottle so the sleeve 3 and tapered parts of the body 1 are also omitted. The worm 14 is mounted on the insertion carrier 10 in such a way as to prevent relative rotational movement therebetween and the insertion carrier 10 is enlarged in at least one direction orthogonal to the longitudinal axis of the worm 14 so that it takes the form of a handle to which the user can apply a torque about the longitudinal axis of the worm 14. The handle may be either integral with or separable from the insertion carrier 10. The worm 14 is then inserted by the user applying both a downward longitudinal pressure and a clockwise torque to the handle in such a way as to drive the worm 14 through the control nut 9 into the cork 4. As shown in FIG. 7 the worm 14 also passes through an upper control nut 27, which serves to improve the rigidity of the extraction carrier 5 and to provide guide means to ensure that the longitudinal axis of the worm 14 remains substantially coincident with the longitudinal axis of the body 1 of the apparatus and hence also with the longitudinal axes of the cork 4 and the bottle 2. The rotary insertion embodiment is therefore superficially similar in operation to a conventional two-lever rack and pinion corkscrew, with the important difference that during the extraction phase the control nut 9 applies to the worm 14 not only a longitudinal force but also a torque which balances the torque applied to the worm 14 by the cork 4, thereby eliminating any tendency for the worm 14 to rotate. This therefore eliminates any tendency for the worm 14 to unwind from the cork 4 on extraction (backing out). In conventional two-lever rack and pinion corkscrews the worm 14 is prevented from backing out by being manufactured with a short pitched helix and/or by not coating the surface of the worm 14 with any friction reducing material. However the rotary insertion embodiment of the present invention allows a worm with a longer pitched helix and a friction reducing coating to be used without any risk of backing out. This means that the present invention enables a smaller number of turns of the insertion carrier 10 to achieve the same depth of insertion in the cork 4, and that as a result of the friction reducing coating the torque to be applied to the insertion carrier 10 will also be reduced. This makes the rotary insertion embodiment of the present invention quicker and easier to use than the conventional two-lever rack and pinion corkscrew. An additional advantage is that the cork 4 may be removed from the apparatus by rotating the insertion carrier 10 in the opposite direction, which will initially cause the cork 4 to jam against the bottom of the control nut 9 and, on continued rotation, will cause the worm 14 to unwind from the cork 4.

It is foreseeable that some embodiments of the present invention could be operated by means of a single lever or pair of levers, provided that the function of this lever or pair of levers could be switched by the user from a mode in which it allowed forces to be applied to the worm (during insertion) to a mode in which it allowed forces to be applied to the control nut (during extraction). Whereas in UK patent No. 2,127,795, a corkscrew is described in which a latch operates to allow the function of a single lever to switch from such a first mode to such a second mode, operation of the latch is not controlled by the user and does not allow the user to decide at what point to switch the function from insertion to extraction. It thus does not allow the user to ensure that extraction is commenced before a short cork is pierced.

Although the embodiments hereinbefore described all describe apparatus in which the rotation of the worm relative to the control nut whenever there is axial movement of the worm relative to the control nut is achieved by means of a control nut acting directly upon the worm, the present invention is not limited to such embodiments but also includes embodiments wherein such relative movement is achieved by means of other helical components mounted on the worm and/or the extraction carrier.

There is a requirement to engage the body of the apparatus positively with the neck of the bottle. This interface fulfills several functions including:

Providing means of directing tensile force between the bottle and the body of the apparatus during the insertion process (not required for the rotary insertion embodiment)

Providing means of directing compressive force between the bottle and the body of the apparatus during the extraction process Providing frictional resistance to the small torque transferred from the control nut to the body during both the insertion and extraction processes so as to prevent rotational movement between the body and the bottle during these processes Providing alignment means for ensuring that the worm is inserted and extracted substantially straight and centrally within the cork and in the direction of the cork's longitudinal axis Preventing any significant relative movement between the apparatus and the bottle during the insertion and extraction processes that could make the apparatus seem precarious on the bottle The tops of wine bottles exhibit a broad range of shapes and sizes and it is commercially important that the bottle engagement means can engage positively with the vast majority of these bottle types. There are many ways in which this could be achieved, which may be drawn from prior art in the field of corkscrews or from other fields. However the manner in which the apparatus engages with the bottle is not a limiting feature of the present invention.

I claim:

1. Apparatus for extracting a cork from a bottle comprising:

engagement means for engaging a bottle;

first actuator means comprising a worm, said worm having an axis extending along its length, said first actuator means being movable in the axial direction of said worm with respect to said engagement means and being rotatable about said axis relative to said engagement means;

second actuator means movable in the axial direction of said worm relative to said first actuator means, said second actuator means and said first actuator means being arranged whereby such relative axial movement therebetween causes rotation of said worm relative to said second actuator means about said axis, said second actuator means being movable with respect to said engagement means in the axial direction of said worm and being substantially prevented from rotating about the axis of said worm with respect to said engagement means;

first actuator control means for controlling the axial movement of said first actuator means relative to said engagement means; and second actuator control means arranged to have forces applied hereto by a user symmetrically with respect to said axis for controlling the axial movement of said second actuator means relative to said engagement means.

2. Apparatus according to claim 1 wherein said worm comprises a substantially helical worm.

3. Apparatus according to claim 1 wherein said first actuator means further comprises means additional to the worm for engaging with said second actuator means and ensuring that relative axial movement between said first and said second actuator means causes a relative rotation therebetween.

4. Apparatus according to claim 1 wherein said second actuator means comprises a control nut having a passage arranged to receive said first actuator means, said first actuator means and said control nut being arranged whereby relative axial movement of said first actuator means in said control nut causes rotation of said worm relative to said control nut about the axis of said worm.

5. Apparatus according to claim 1 wherein said first actuator control means comprises a first force conversion means for converting applied forces into longitudinal forces acting on said first actuator means in the axial direction of said worm.

6. Apparatus according to claim 5 wherein said first actuator control means further comprises a first force application means whereby a user may apply a force to said first force conversion means.

7. Apparatus according to claim 6 wherein said first force application means comprises a first pair of arms pivoted substantially symmetrically about said first force conversion means.

8. Apparatus according to claim 1 wherein said second actuator control means comprises a second force conversion means for converting applied forces into longitudinal forces acting on said second actuator means in the axial direction of said worm.

9. Apparatus according to claim 8 wherein said second actuator control means further comprises a second force application means whereby a user may apply a force to said second force conversion means.

10. Apparatus according to claim 9 wherein said second force application means comprises a second pair of arms pivoted substantially symmetrically about said second force conversion means.

11. Apparatus according to claim 1 wherein said first actuator control means and said second actuator control means comprise a common user interface means comprising a force application means and a switching means for switching between:

1. a first mode in which applied forces are converted into longitudinal forces acting on said first actuator means in the axial direction of said worm;
2. a second mode in which applied forces are converted into longitudinal forces acting on said second actuator means in the axial direction of said worm;

wherein said switching means allows a user to control the axial movement of said second actuator means separately from the axial movement of said first actuator means.

12. Apparatus for extracting a cork from a bottle comprising:

engagement means for engaging a bottle;

first actuator means comprising a worm, said worm having an axis extending along its length, said first actuator means being rotatable about said axis relative to said engagement means;

second actuator means movable in the axial direction of said worm relative to said first actuator means, said second actuator means and said first actuator means being arranged whereby such relative axial movement therebetween causes rotation of said worm relative to said second actuator means about said axis, said second actuator means being movable with respect to said engagement means in the axial direction of said worm and being substantially prevented from rotating about the axis of said worm with respect to said engagement means;

first actuator control means for controlling the movement of said first actuator means relative to said engagement means; and second actuator control means arranged to have forces applied thereto by a user symmetrically with respect to said axis for controlling the axial movement of said second actuator means relative to said engagement means.

13. Apparatus according to claim 12 wherein said worm comprises a substantially helical worm.

14. Apparatus according to claim 12 wherein said first actuator means further comprises means additional to the worm for engaging with said second actuator means and ensuring that relative axial movement between said first and said second actuator means causes a relative rotation therebetween.

15. Apparatus according to claim 12 wherein said second actuator means comprises a control nut having a passage arranged to receive said first actuator means, said first actuator means and said control nut being arranged whereby relative axial movement of said first actuator means in said control nut causes rotation of said worm relative to said control nut about the axis of said worm.

16. Apparatus according to claim 12 wherein said first actuator control means comprises rotary insertion means whereby a user may apply a torque to said first actuator means about the axis of said worm.

17. Apparatus according to claim 12 wherein said second actuator control means comprises a second force conversion means for converting applied forces into longitudinal forces acting on said second actuator means in the axial direction of said worm.

18. Apparatus according to claim 17 wherein said second actuator control means further comprises a second force application means whereby a user may apply a force to said second force conversion means.

19. Apparatus according to claim 18 wherein said second force application means comprises a second pair of arms pivoted substantially symmetrically about said second force conversion means.

* * * * *